US010907403B2

(12) United States Patent
Pemberton

(10) Patent No.: US 10,907,403 B2
(45) Date of Patent: Feb. 2, 2021

(54) REPLACEMENT WINDOW PANEL WITH AIR CONDITIONER COUPLING

(71) Applicant: Edward Lee Pemberton, Bothell, WA (US)

(72) Inventor: Edward Lee Pemberton, Bothell, WA (US)

( * ) Notice: Subject to any disclaimer, the term of this patent is extended or adjusted under 35 U.S.C. 154(b) by 0 days.

(21) Appl. No.: 16/406,352

(22) Filed: May 8, 2019

(65) Prior Publication Data

US 2019/0345756 A1 Nov. 14, 2019

Related U.S. Application Data

(60) Provisional application No. 62/669,983, filed on May 11, 2018.

(51) Int. Cl.
*E06B 7/03* (2006.01)
*F24F 13/14* (2006.01)
*E06B 7/08* (2006.01)

(52) U.S. Cl.
CPC ..... *E06B 7/03* (2013.01); *E06B 7/08* (2013.01); *F24F 13/14* (2013.01)

(58) Field of Classification Search
CPC ..... E06B 7/03; E06B 7/02; E06B 7/08; E06B 7/084; E06B 7/082; F24F 7/013; F24F 13/14
USPC ..... 52/171.3, 209, 220.8, 302.1
See application file for complete search history.

(56) References Cited

U.S. PATENT DOCUMENTS 2,561,928 A * 7/1951 Johnston ..... E06B 7/03 392/372
3,462,966 A * 8/1969 Reid ..... F25D 21/04 62/248
3,830,147 A * 8/1974 Weber ..... F24F 7/00 454/222
4,186,656 A * 2/1980 Weber ..... E06B 7/02 454/222
4,214,380 A * 7/1980 Meyer ..... D06F 58/20 34/235
4,334,461 A * 6/1982 Ferguson ..... F24F 7/00 285/189
4,338,731 A * 7/1982 Shames ..... D06F 58/20 137/875
4,627,206 A * 12/1986 Cox ..... E06B 7/12 454/198

(Continued)

OTHER PUBLICATIONS

WeatherMaster Hopper Window & Dryer Vent, (https://www.bestlouver.com/weathermaster-hopper-window/Aug. 29, 2016).*

*Primary Examiner* — Brian E Glessner
*Assistant Examiner* — Adam G Barlow
(74) *Attorney, Agent, or Firm* — Paul B. Heynssens Attorney at Law, PLC

(57) ABSTRACT

A window replacement panel including an air conditioning vent incorporated into it. A window assembly may be attached to a decorative panel with a vent disposed on a first side, and a coupling for an AC duct on an opposite side. The window may be a single, double pane, insulated, uninsulated or the like. The panel may be clad with material to harmonize with the building exterior, and the exterior vent presents a pleasing appearance. The combination of window and panel may be sized to replace an existing window, or may be used in new construction.

18 Claims, 18 Drawing Sheets

(56) References Cited

U.S. PATENT DOCUMENTS

| | | | | | |
|---|---|---|---|---|---|
| 5,568,947 | A * | 10/1996 | Paquette | E04F 17/04 | 285/192 |
| 5,755,069 | A * | 5/1998 | Sullivan | E06B 7/082 | 454/277 |
| 5,906,083 | A * | 5/1999 | Olsen | E06B 7/08 | 454/277 |
| 6,443,834 | B1 * | 9/2002 | Berger | F24F 13/06 | 454/353 |
| 6,481,167 | B2 * | 11/2002 | Liddell | E06B 7/086 | 52/198 |
| 6,564,512 | B1 * | 5/2003 | Whittemore | B08B 15/00 | 248/694 |
| 7,254,924 | B2 * | 8/2007 | Regina | E04C 1/42 | 52/171.3 |
| 7,284,412 | B1 * | 10/2007 | Perrault | G01M 3/04 | 116/211 |
| 8,046,960 | B1 * | 11/2011 | Kapany | F24S 20/63 | 52/171.3 |
| 8,181,400 | B2 * | 5/2012 | Kindschuh | E06B 3/677 | 52/171.3 |
| 2004/0211162 | A1 * | 10/2004 | Henrikson | B01D 46/10 | 55/385.2 |
| 2011/0155365 | A1 * | 6/2011 | Wiese | F24F 7/013 | 165/244 |
| 2017/0362883 | A1 * | 12/2017 | Kanno | E06B 7/10 | |

* cited by examiner

Detail
1050

Vent-Movable Louvers
107

Vent-Fixed Louvers
107

104

Cap
111

100

100

100

100

100

Panel
Assy.
101

Panel
Assy.
101

REPLACEMENT WINDOW PANEL WITH AIR CONDITIONER COUPLING

CROSS-REFERENCE TO RELATED APPLICATION

This application claims the benefit of U.S. Provisional Patent Application No. 62/669,983 filed May 11, 2018, the contents of which are hereby incorporated by reference.

TECHNICAL FIELD

This description relates generally to building materials and more specifically to window replacement panels.

BACKGROUND

Windows may be constructed so that they open so that light and air can enter a structure. Alternatively, a window may be fixed in configuration so that it may not be opened. Typical residential construction utilizes sliding windows that may be opened. Fixed window panes for apartments, high rises and the like often may not be opened for safety, or so that climate is controlled entirely by the central heating and air conditioning ("AC" or "A/C") unit. However, as many people who have occupied such spaces can attest to, such central heating and AC may not be effective, and individual adjustment for a given space may not be possible. In particular if the AC is lacking or inadequate, it can be frustrating to not be able to simply open a window for ventilation, or to install a window AC unit. In particular such fixed windows may often be made as a panel assembly, and may be insulated, or double pane in construction. So, simply cutting a hole in the window to install an AC may not be practical. Likewise, many homes with sliding windows, may lack AC, and the ability to install a window AC without filler panels may be desirable as well.

Portable, or window air conditioners typically are vented to the outside environment through ducting or being placed in a window so that they directly vent. AC units may be window mounted or freestanding with a hot air exhaust vented with a tube or duct. Typically a filler panel may be used to cover vacant space in the sliding window opening around a window unit, or a duct from a freestanding unit. However, such fillers typically produce a security risk because the window cannot be locked. Also, the fillers are typically unattractive and do not provide a weather tight, or energy efficient seal. Accordingly, an attractive replacement window panel that provides an energy efficient and secure seal while allowing an air conditioner to properly vent may be desirable.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The present example provides a window replacement panel including an air conditioning vent incorporated into it. A window assembly may be attached to a panel assembly with a vent disposed on a first side, and a coupling for an AC duct on an opposite side. The window assembly may be a single, double pane, insulated, uninsulated or the like. The panel assembly may typically include a core clad with material to harmonize with the building exterior, and the exterior vent presents a pleasing streamlined appearance. The combination of window and panel may be sized to replace an existing window, or may be used in new construction.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe a flat window replacement panel. Although the present examples are described and illustrated herein as being implemented in a planar window system, the system described is provided as an example and not a limitation. As those skilled in the art will appreciate, the present examples are suitable for application in a variety of different types of window pane replacement systems.

Figure 1:
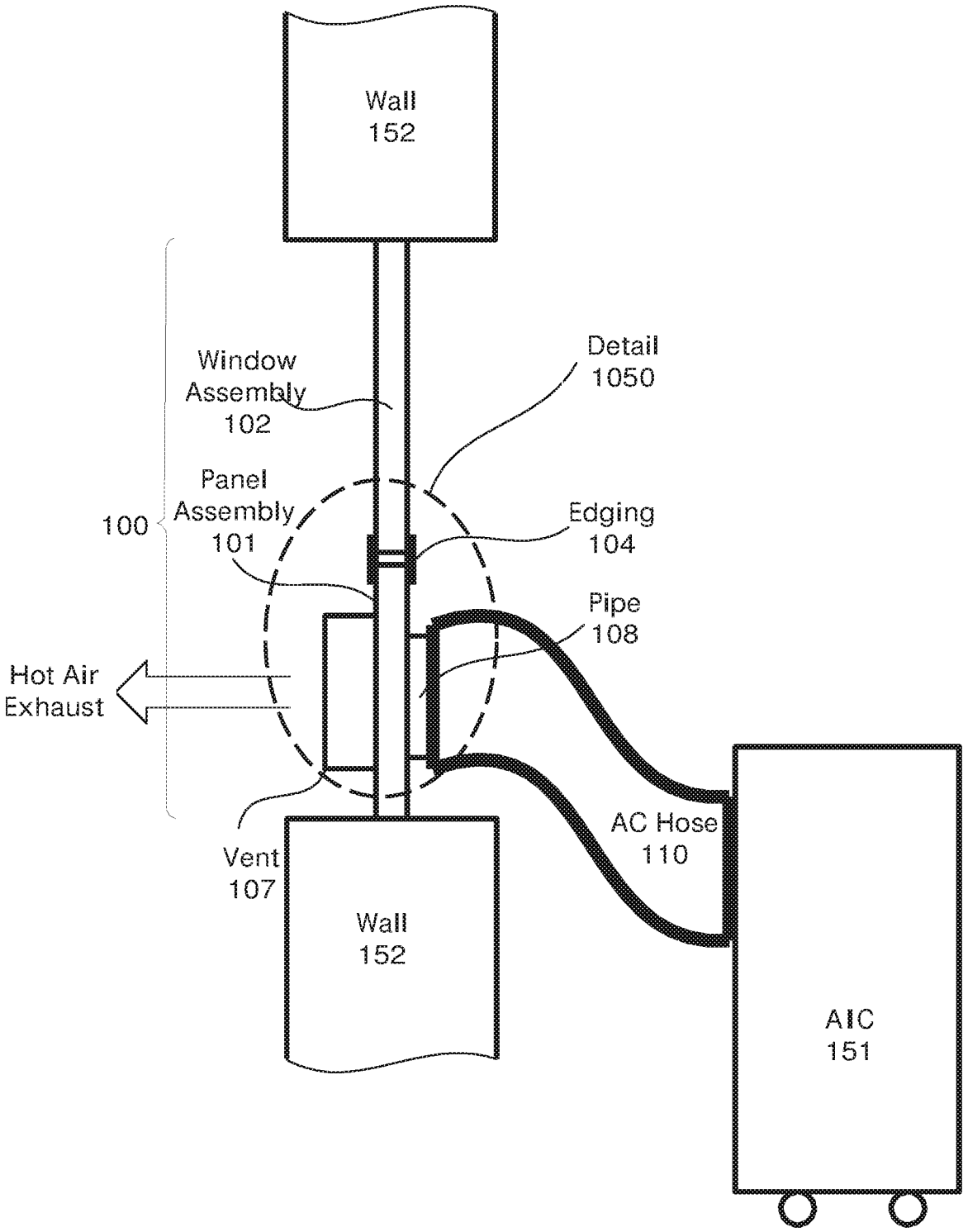
FIG. 1 shows a window replacement panel with air conditioning coupling installed in a wall and coupled to an air conditioning unit.

FIG. 1 shows a window replacement panel with air conditioning coupling 100 installed in a wall 152 and coupled to an air conditioning unit 151. The window replacement panel with air conditioning coupling 100 is a typically rigid unit that may be custom sized to replace an existing window in a building, or installed in new construction. The window replacement panel with air conditioning coupling 100 may be installed by methods known to those skilled in the art into an opening in a wall 152. The instillation of the panel 100 may be flush with an exterior wall, centered (as shown) in the wall opening, or otherwise situated as desired in a window opening.

The window replacement panel with air conditioning coupling 100 typically includes a window assembly 102 coupled to a panel assembly 101 forming a unitary assembly for instillation. The coupling may include edging or trim strips 104 to provide a pleasing appearance and to cover the junction of the panel assembly 101 and window assembly 102. Although the window assembly 102 and panel assembly 101 are shown as substantially the same thickness, in alternative examples the two assemblies may be of different thicknesses, typically with appropriate edging selected to cover the junction, and present an aesthetically pleasing appearance.

The panel assembly 101 typically includes an exterior vent 107 that vents hot air from the AC unit 151 via an AC Hose 110 coupled to an pipe 108 to the outside of the building. The panel assembly 101 may be a single material, a laminate or the like. In alternative examples the panel assembly may be flanked by glass on either or both sides, and/or on the bottom as well. A feature of the examples provided is that a panel 101 containing an air conditioning vent 107 may be disposed, in or, adjacent to, one or more window panels to form a unitary assembly for replacing an existing window and frame (or used in new construction).

The window assembly 102 is typically a single piece. However, in alternative examples the window assembly, multiple window panes may make up the window assembly-including a mix of glass and other panel materials. Each window assembly panel 102 may be single pane, double pane, or the like.

The replacement panels 100 may be advantageously constructed to replace an existing window panel to provide air conditioning venting. Accordingly the panels may be fabricated in any desired size to fit an existing window. Also, as will be realized by those skilled in the art the replacement panel 100 can include more than one glass window assembly 102 with a panel 101 disposed there between in the vertical direction. Or alternatively the panel shown in the examples below as being horizontally oriented may also be oriented vertically (with the vent accordingly oriented) along one side or the other (right or left) of the window 102.

Figure 2:
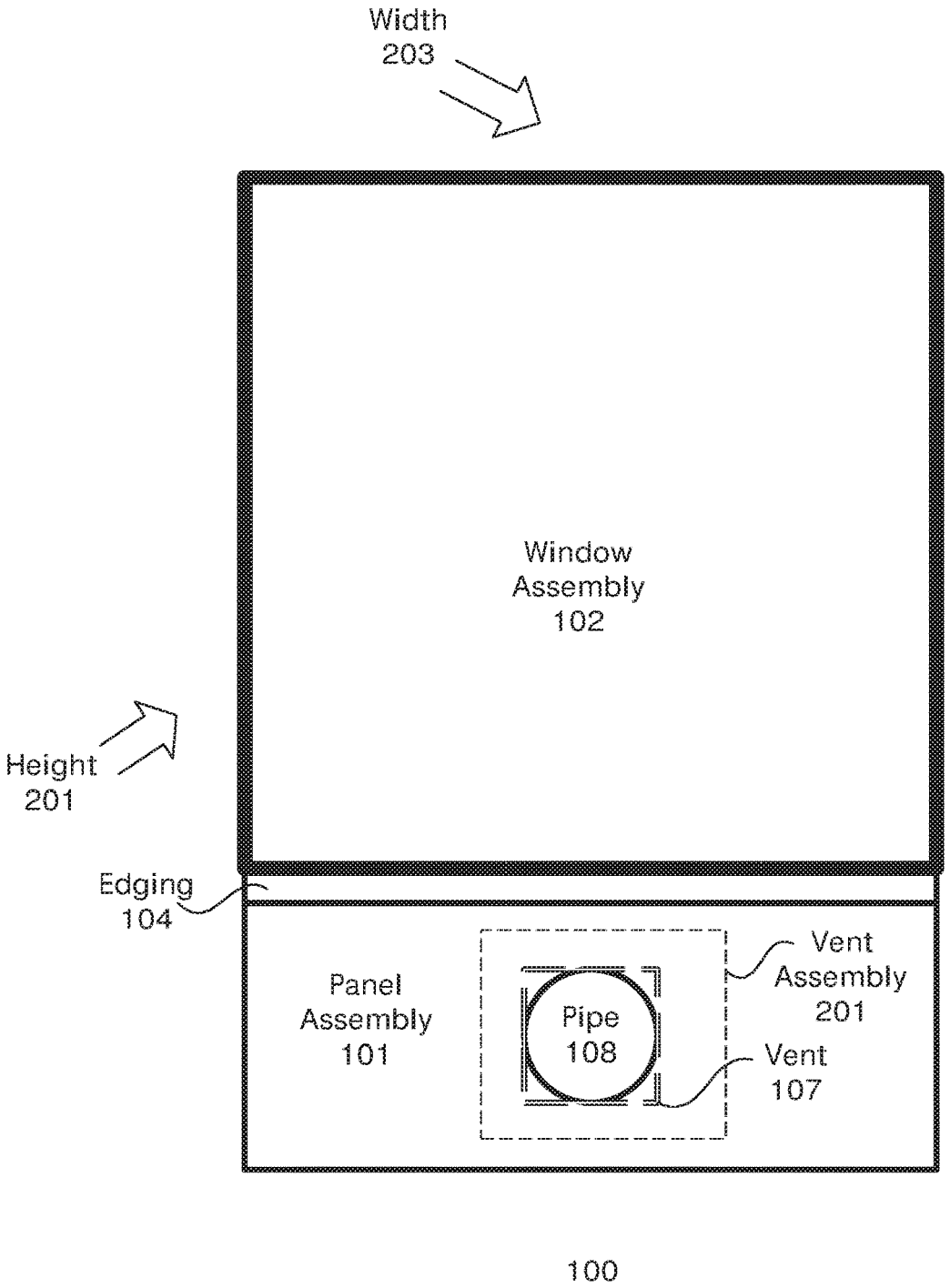
FIG. 2 is a front view of the window replacement panel with air conditioning coupling.

FIG. 2 is a front view of the window replacement panel with air conditioning coupling 100 as would be seen looking from the inside of a building to the outside. In this typical configuration the overall shape is rectangular or square, in which the width 203 of the window assembly and the panel assembly are equal. The height 201 of window assembly 102, and the panel assembly 101 typically differ, with the height of the window assembly 102 typically exceeding that of the panel assembly 101. The edging 104 covering a gap between assemblies 102, 101 is typically a planar strip, however in alternative examples it may have other forms.

The vent assembly 201 may include a pipe 108 coupled to a vent 107. The vent assembly 201 is typically inserted in an aperture disposed in the panel assembly 101. The aperture is typically slightly larger than the pipe 108, as the pipe of the vent assembly 201 is inserted into the aperture until the vent 107 is flush against the opposite side of the panel assembly 101 surface. Gasketing or sealant (not shown) may be used between the vent 107 and the panel assembly 101 to provide a substantially airtight connection. Sealant (not shown) may also disposed between the pipe 108 and panel assembly aperture sides as well.

Figure 3:
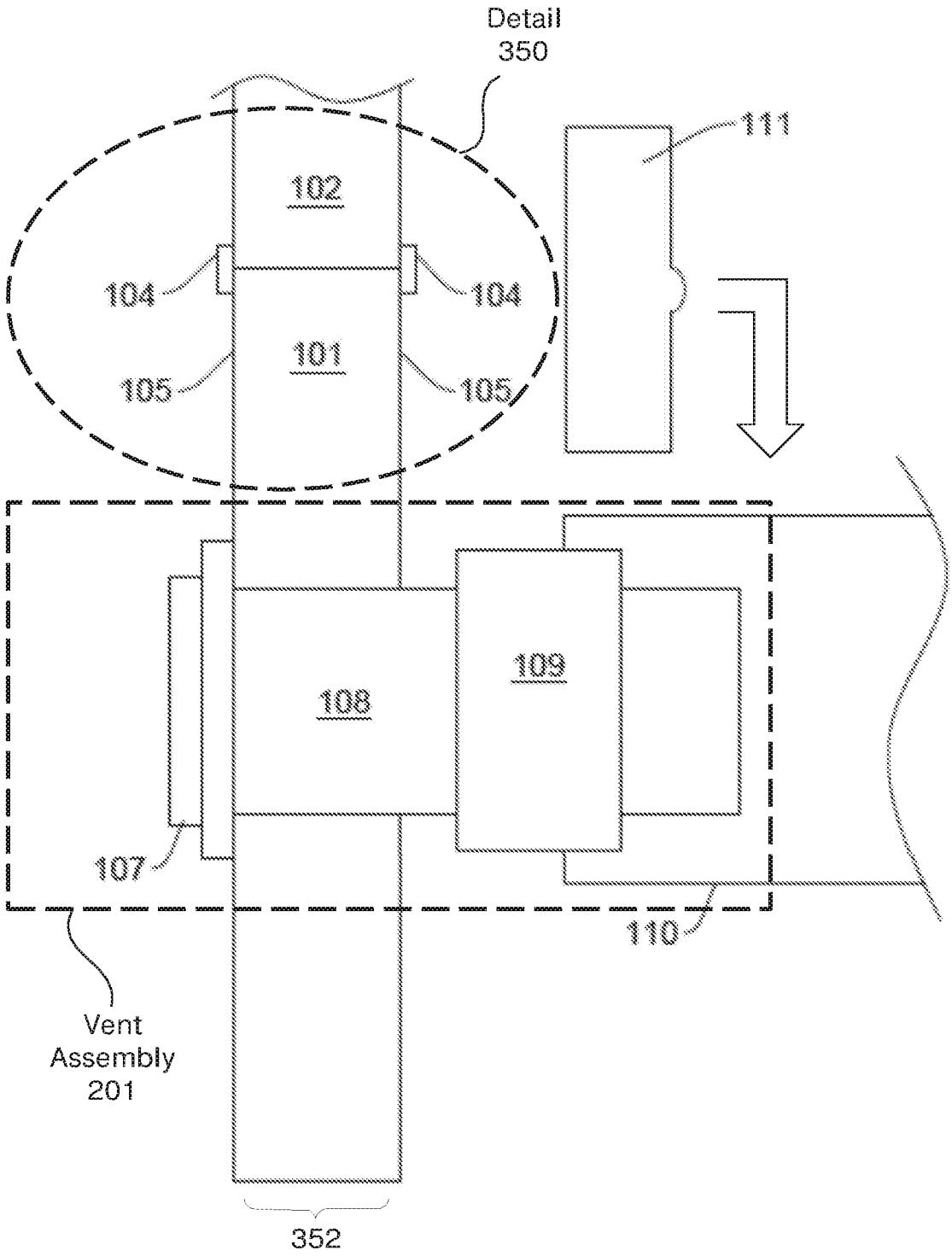
FIG. 3 shows a cross section of a window replacement panel with an air conditioning coupling.

FIG. 3 shows a cross section of a window replacement panel with an air conditioning coupling (detail 1050 of FIG. 1). In this view the details of the vent assembly 201 are shown. The vent assembly 201 includes a vent 107 attached to a pipe 108. The vent assembly 201 may also include a gasket 109, and a cap 111.

In detail 350 a window assembly 102 is disposed abutting against a panel assembly 101 having cladding 105 on both sides. The joint created by the abutment of assemblies 102, 101 is covered by an edging strip 104 on each side of the panel.

A vent assembly 120 is disposed in an aperture disposed in the panel 352 with the back surface of an outer flange against the panel 352 outer surface. The vent 107 of the vent assembly 201 may be fixedly coupled to the panel 101 by screws, hardware, adhesive or the like. Caulk or equivalent sealants may be utilized to seal the vent assembly to the panel. In an alternative example the vent may be constructed such that it is substantially flush with the outer surface of the outer panel (countersunk), or in a further alternative example constructed as part of the panel so that the raised appearance of the external vent frame is reduced and less noticeable.

Pipe 108 extends through the panel 101 where it is encircled by a gasket 109, over which an air conditioner hose 110 may be disposed. The pipe length typically exceeds the thickness of the panel laminate by a sufficient amount to allow a typically 2 inch long gasket to be disposed over the pipe. An exemplary pipe length is 4 inches. The gasket 109 may be slipped over or otherwise installed over a length of pipe extending into a room. The gasket typically relies on a friction fit to maintain it in place on the pipe 108 and to remain in place when the AC hose 110 is coupled to the pipe 108. The AC hose 110 may be held in place by friction, or an optional clamp (not shown), or the like.

The cap 111 may be used to cover the exposed pipe 108, when an AC hose 110 is not coupled to the pipe, so as to create a more pleasing appearance to occupants of the room. For shipping the gasket 109 may be folded up inside of the pipe and secured by the cap 111 to keep the gasket from falling out.

Figure 4:
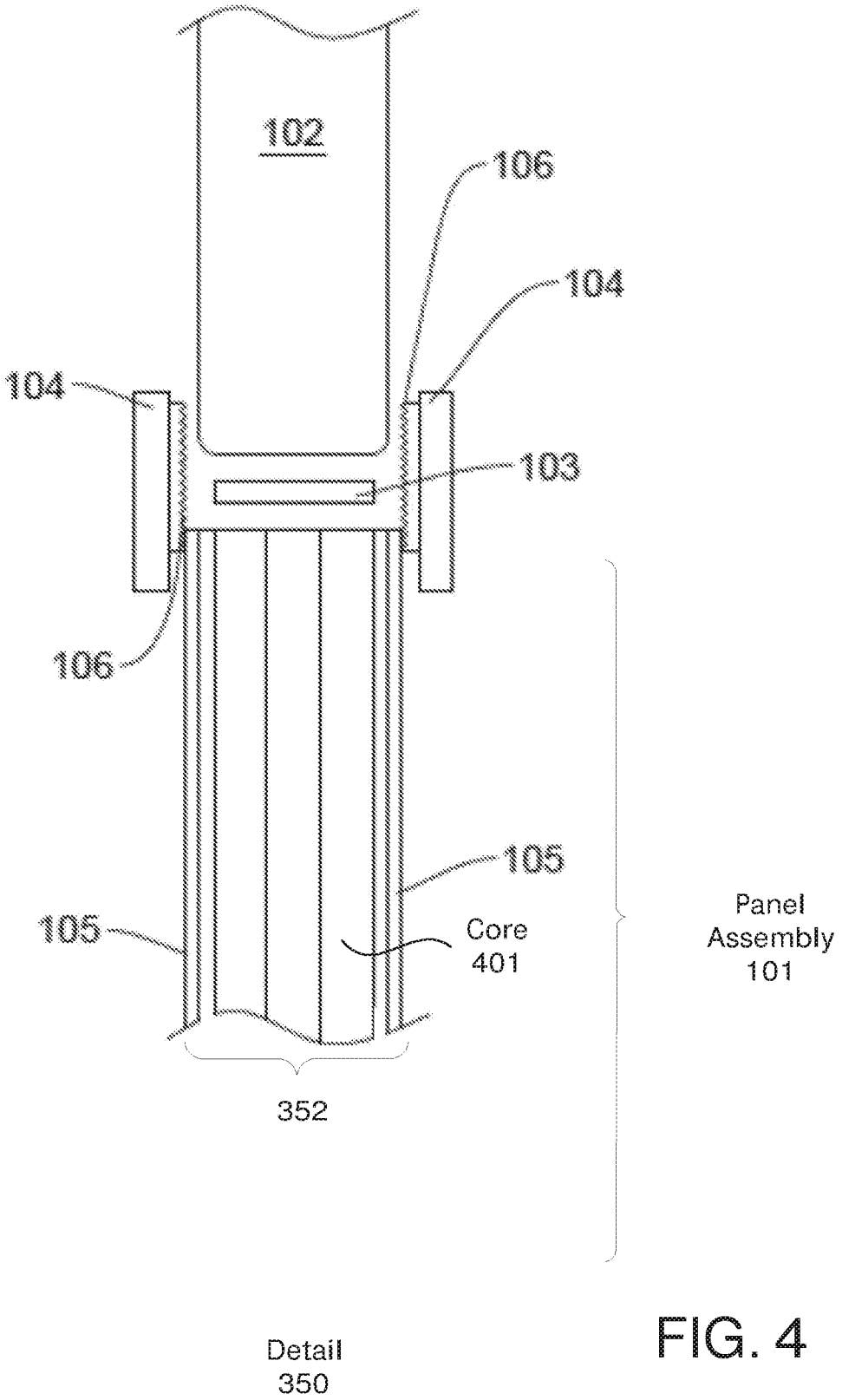
FIG. 4 shows an end view of the window replacement panel with an air conditioning coupling where a window couples to a panel.

FIG. 4 shows an end view of the window replacement panel with an air conditioning coupling (detail 350 of FIG. 3) where a window assembly 102 couples to the panel assembly 101. This portion of the window replacement panel provides a somewhat rigid attachment of the window assembly 102 to the panel assembly 101.

As previously described the window assembly 102 may include safety glass, tempered glass, or the like, which is typically of the dual pane dual seal type. Window thickness may range from ¼ to ½ inch thickness. However, ½ to 1 inch thickness is typical. Alternatively single pane, double pane or other equivalent glass or translucent glass structures may be used.

One or more materials may be stacked or laminated to form a desired panel structure and thickness in the panel assembly 101. The panel 352 may typically have a core 401 made from ACX plywood. However a variety of materials are contemplated for the core 401 such as foam, composite materials, poly carbonate ribbed material and the like.

The core 401 may typically be clad with sheeting 105, forming the laminated panel 352, to enhance its appearance and protect it from the elements. An aperture (not shown) is typically disposed in the panel laminate 352, and is typically round. However alternative shapes such as square, rectangular or the like are contemplated. In the present example aluminum sheeting 105 with an appropriate coating (anodizing, paint, powder coating, plastic or equivalent) may be bonded to the core 401, via glue, adhesive sheets or the like to form a completed panel 352 (with the panel assembly 101 which may include the laminated panel 352, an aperture, and the vent assembly 201, not shown in this figure). The edges of the panel and exterior cladding may be provided with an edging if desired.

Alternatively, various other claddings and prefabricated laminates are contemplated including having differing claddings on opposite sides.

The window assembly 102 abuts the panel 352 with typically ¼'×40 mil thick acrylic foam tape 103, or equivalent disposed there between. Aluminum (or equivalent) strips 104 may be utilized to cover the joint formed where the window assembly 102 abuts the panel assembly 101. In the example provided clear silicone RTV 106 or its equivalent may be used to attach the strips 104 to the window 102 and the panel 101.

In an alternative example of a panel 101 an insulated glazing insert panel that consists of a foam plastic core is bonded on both sides to thermoplastic stabilizers with finished sheets of aluminum on each face. Such a panel typically may include edge treatment allowing for metal-to-metal butt-glazed joints to create hairline joints. These panels are intended for use in window, glazing, and curtain wall systems, panels are available with smooth or stucco-embossed finishes and in thicknesses ranging typically from ¾ to 3½. Such panels as described above are commercially available under the trade name Thermolite™ and Thermolite WE™ Manufactured by Laminators Inc. located at 3255 Penn Street, Hatfield, Pa. 19440.

Figure 5:
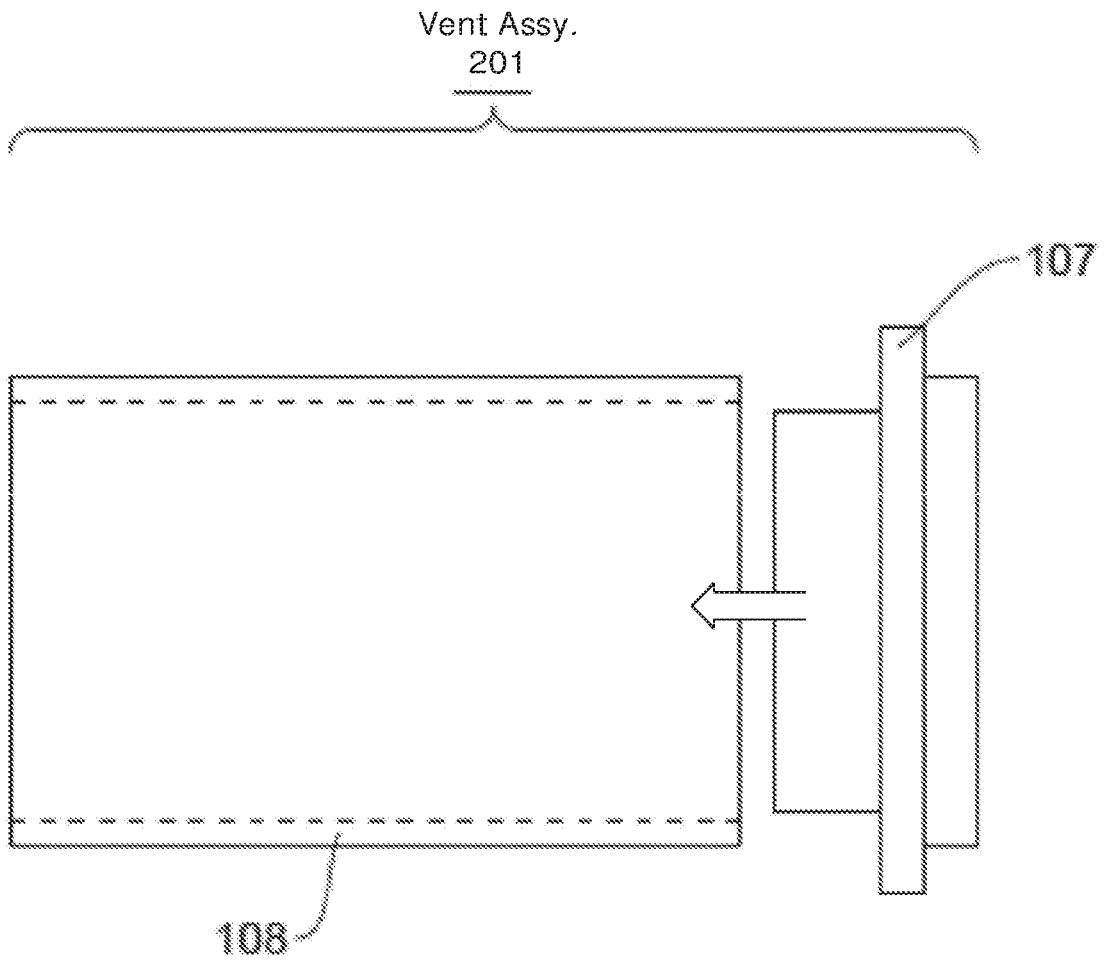
FIG. 5 shows the construction of a vent assembly for insertion into the panel.

FIG. 5 shows the construction of a vent assembly 201 for insertion into the panel. A PVC (poly vinyl chloride) pipe, or equivalent material pipe, 108 may be fixedly coupled to a rear protrusion of a vent 107. Typically to provide attachment the surface of the vent protrusion may be roughed up, primed and then attached to pipe 108 with PVC cement or by equivalent attachment methods. The exemplary pipe 108 may be four inch stock PVC pipe. In alternative examples a vent with an extended protrusion may be provided so that the pipe is not needed. The vent may have fixedly open louvers or may be of the type that normally closed, and opens when air pressure is applied to it (self closing louvers). Alternatively other equivalent baffling screening or the like is contemplated as substitutes for the louvers.

In further alternative examples of a panel assembly (101 of FIG. 1) a panel may be formed, or molded with a unitary vent assembly.

Figure 6:
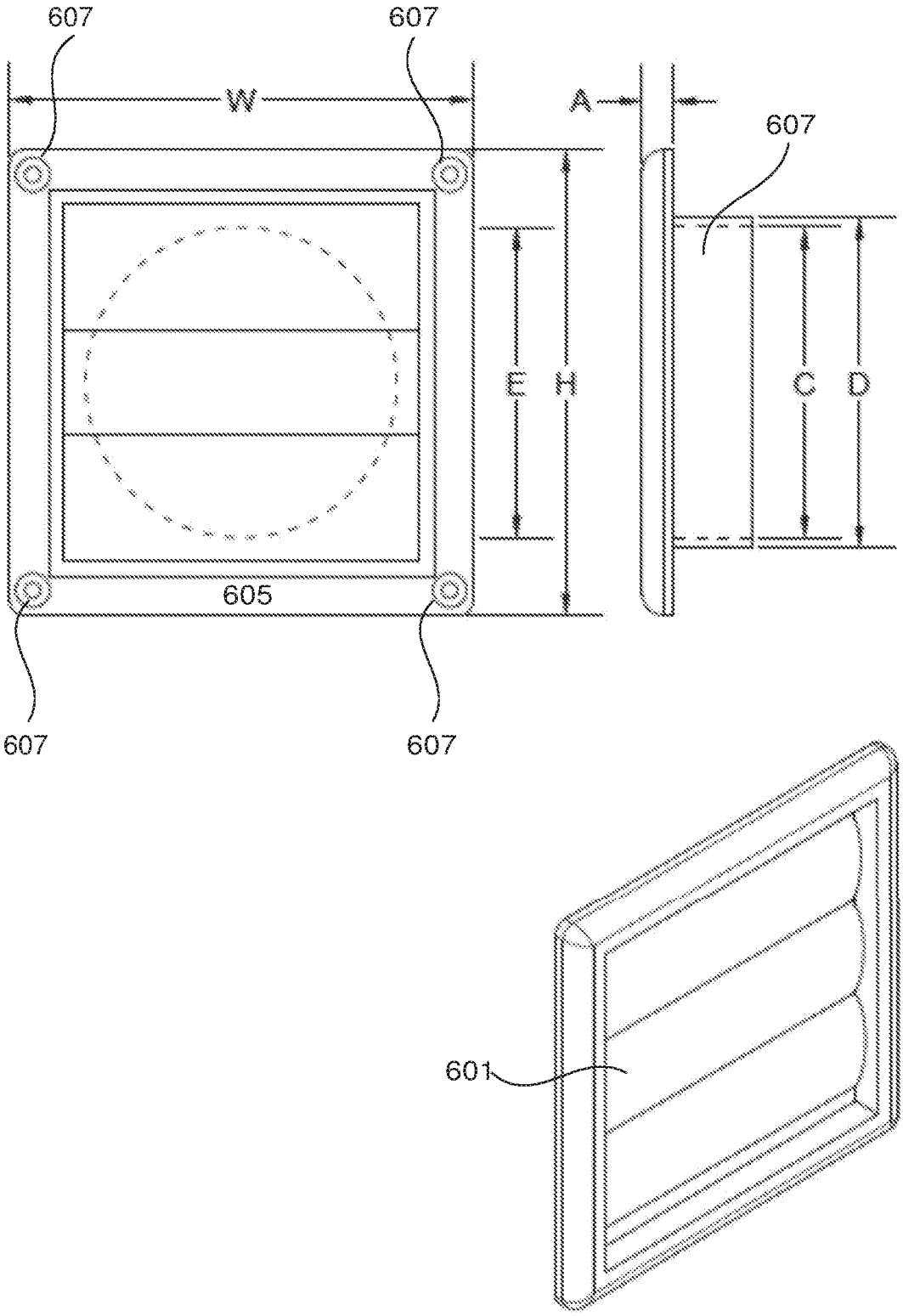
FIG. 6 shows a vent with movable louvers.

FIG. 6 shows typical vent 107 with movable louvers. The louvers 601 are normally closed, and open when air pressure impinges upon the louvers (self closing louvers). A typical vent includes a square or rectangular flange 605 with one or more apertures 607 for mounting hardware (not shown). The flange 605 also serves as a mounting frame for the louvers 601. Extending from the back side of the frame is a typically circular hollow flange 609 for coupling to a variety of pipe, or hose sizes. As shown the vent 107 may be constructed in a number of sizes and configurations as shown:

| Size (IN) | A | C | D | E | W/H | LOUVERS | FREE AREA IN$^2$ |
|---|---|---|---|---|---|---|---|
| 4 | $\frac{7}{16}$ | $4\frac{1}{8}$ | $4\frac{1}{4}$ | 4 | 6 | 3 | 12.57 |
| 6 | $\frac{7}{16}$ | $6\frac{1}{8}$ | $6\frac{1}{4}$ | 6 | $8\frac{1}{8}$ | 3 | 28.27 |
| 8 | $\frac{5}{8}$ | $7\frac{3}{4}$ | $7\frac{7}{8}$ | $7\frac{3}{4}$ | 10 | 5 | 50.26 |

The above dimensions are exemplary and not limiting.

The vent is typically constructed from high density polyethylene ("HDP"), PVC or equivalent. In alternative examples of a vent other frame sizes and shapes are contemplated such as round, oval and the like.

Figure 7:
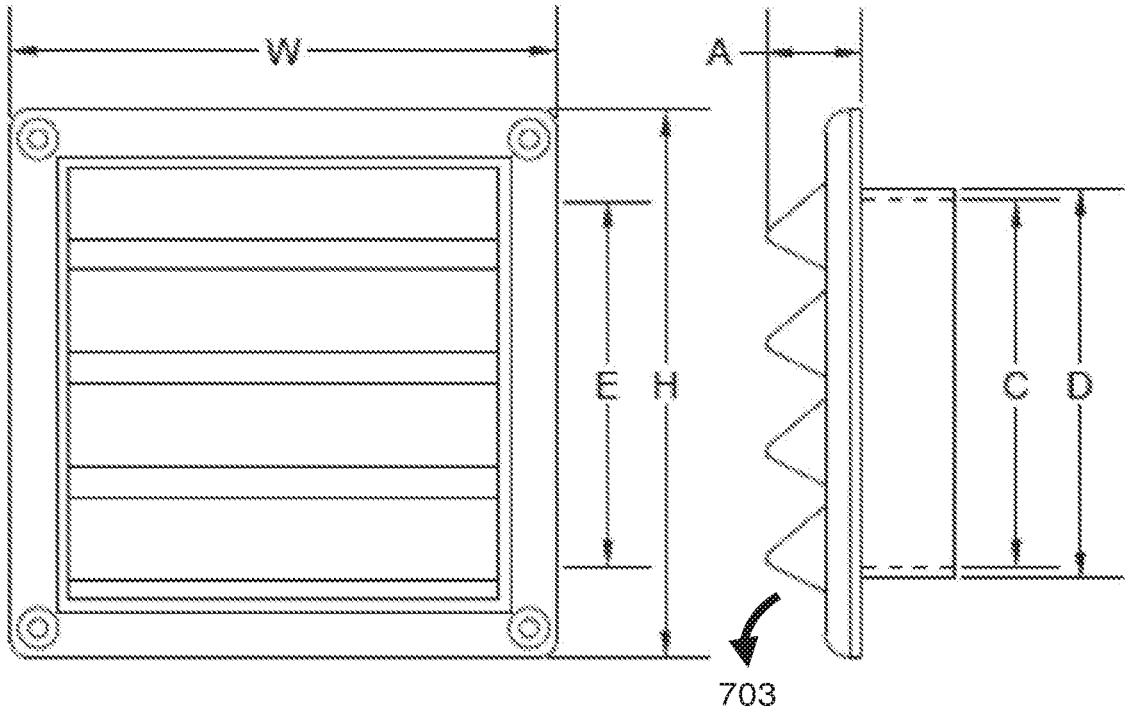
FIG. 7 shows a vent with fixed louvers.
Figure 7:
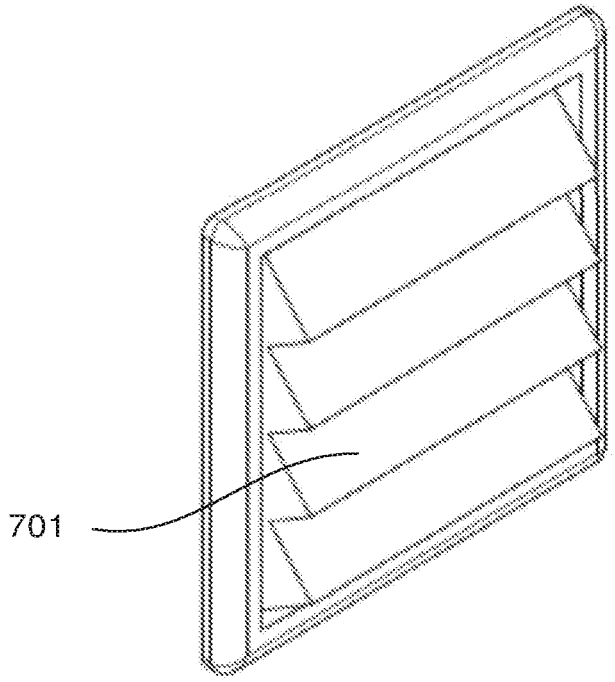

FIG. 7 shows a vent 107 with fixed louvers. This alternative exemplary vent is constructed as described in FIG. 6, with the exception of the louvers 701 being fixed in position and constructed such that airflow 702 is directed downward, and the intrusion of rain in the like is typically minimized. As shown the vent 107 may be constructed in a number of sizes and configurations as shown:

| Size (IN) | A | C | D | E | W/H | LOUVERS | FREE AREA IN$^2$ |
|---|---|---|---|---|---|---|---|
| 4 | $1\frac{1}{16}$ | $4\frac{1}{8}$ | $4\frac{1}{4}$ | 4 | 0 | 4 | 10.30 |
| 6 | $1\frac{2}{3}$ | $6\frac{1}{8}$ | $6\frac{1}{4}$ | 6 | $8\frac{1}{8}$ | 5 | 19.30 |
| 8 | $1\frac{1}{2}$ | $7\frac{5}{8}$ | $7\frac{3}{4}$ | $7\frac{5}{8}$ | 10 | 6 | 35.18 |

The above dimensions are exemplary and not limiting.

Figure 8:
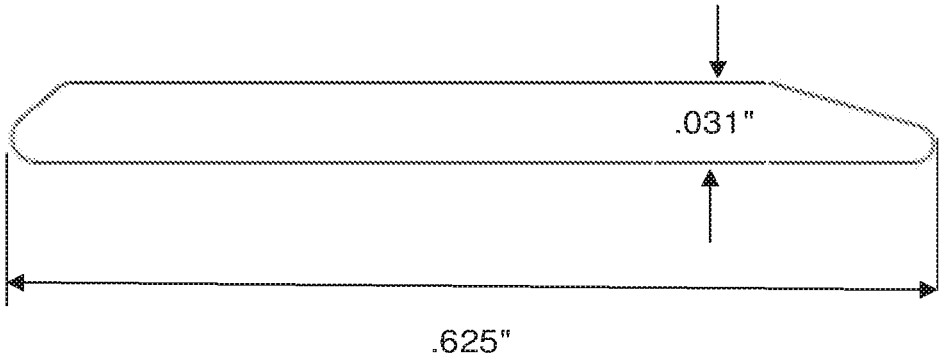
FIG. 8 shows the edging.
Figure 8:
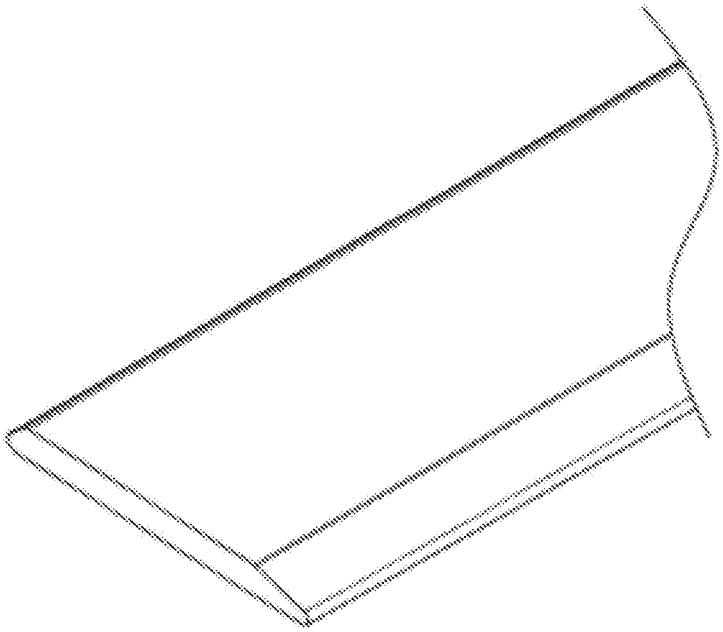

FIG. 8 shows the exemplary edging 104. The edging shown is exemplary. Other widths and thicknesses are possible, as well as materials, bevels, and the like.

The edging is typically a flat strip of aluminum or equivalent material (including non-metallic materials) that may be coated, painted, or the like, or left natural. The edging has an exemplary thickness of 0.31 inches, and an exemplary width of 0.625 inches. The thickness and width are typically selected to provide a panel assembly (not shown) and a window assembly (not shown) sufficient strength and rigidity when they are held together with the methods described herein, including the edging strips.

The edges of the edging strip 104 may be beveled, rounded, or otherwise shaped to produce a pleasing appearance or effect. Beveling is typically on the exterior side, with the side that will be facing the panel (not shown) being wider, and planar so as to fit against the planar panel surface.

In an alternative example the edging may be supplied with an adhesive backing. Such an adhesive backing typically includes a release sheet disposed over the adhesive.

Figure 9:
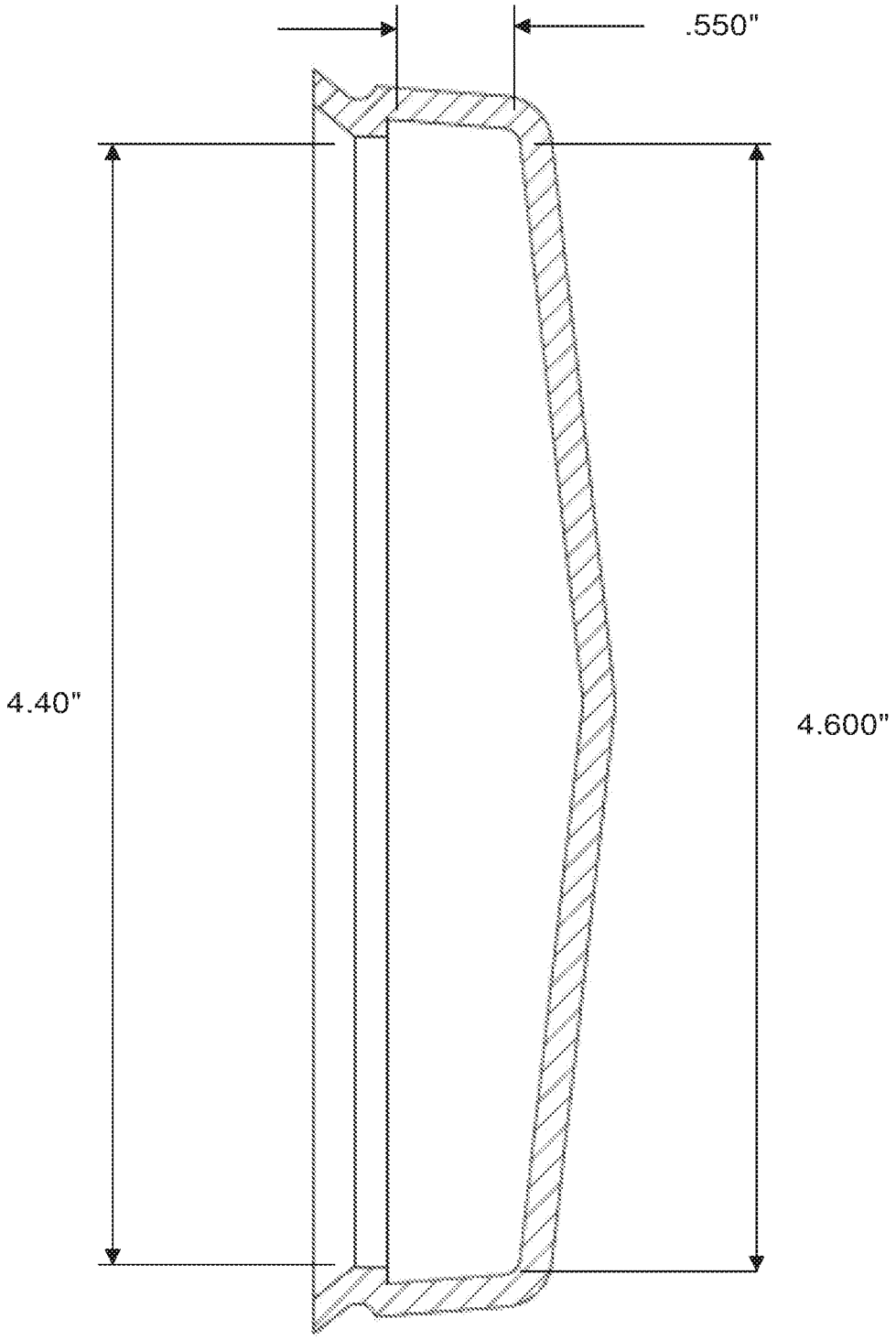
FIG. 9 shows the cap.

FIG. 9 shows the cap 111. The cap is typically made from vinyl or equivalent, having the exemplary dimensions shown, and flexibility to fit over an exemplary four inch PVC pipe. In alternative examples different shapes of cap are possible, including a cap with an integral aperture (not shown) that may be used with retaining hardware such as a string, or chain (not shown) to hold the cap to the assembly when it has been removed from the pipe (not shown). Alternatively a threaded cap may be provided to couple with a threaded pipe, as well as other equivalent devices for fastening the cap to the pipe.

Figure 10:
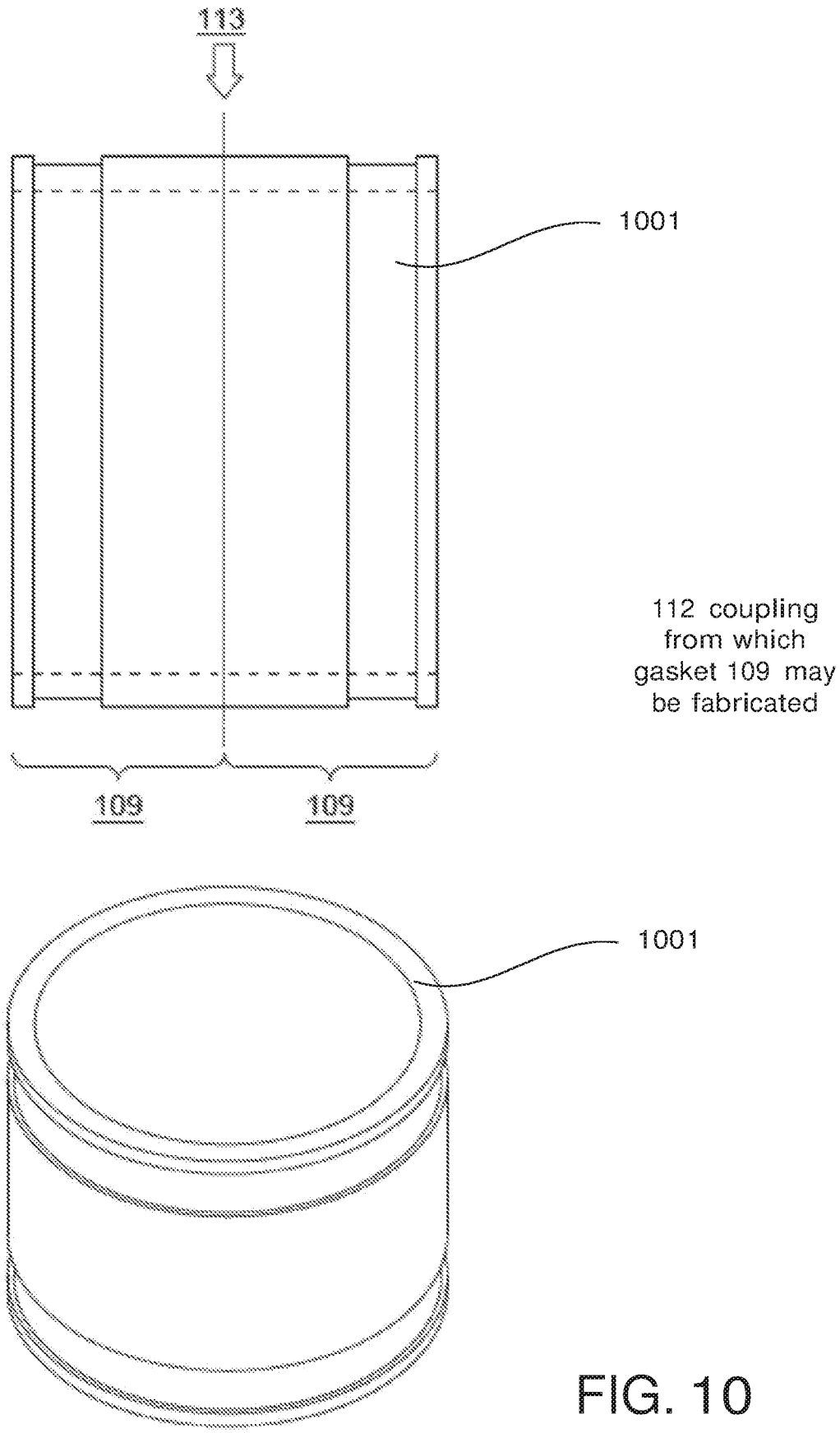
FIG. 10 shows a flexible coupling from which the gasket may be formed.

FIG. 10 shows a flexible coupling from which the gasket may be formed. Here the gasket is advantageously fabricated from a commercially available flexible pipe coupling 1001 by separating it into one or more lengths 109. The material of the coupler is typically chosen to be flexible such as Flexible PVC (PVC with the addition of plasticizers) 60 duro shore a, neoprene, or equivalent. The gasket need not have the groves as shown, as those are intended for the pipe coupler usage in which screw type stainless steel hose clamps typically are mounted. The dimensions shown are intended to be exemplary, and not limiting. Those skilled in the art will realize that numerous equivalent gasket configurations are possible.

In alternative examples a single gasket may be custom fabricated from the indicated material or equivalent materials like foam and the like. For example a simple tube of appropriate materials of sufficient diameter to fit over the vent pipe may simply be cut to the appropriate length.

Figure 11:
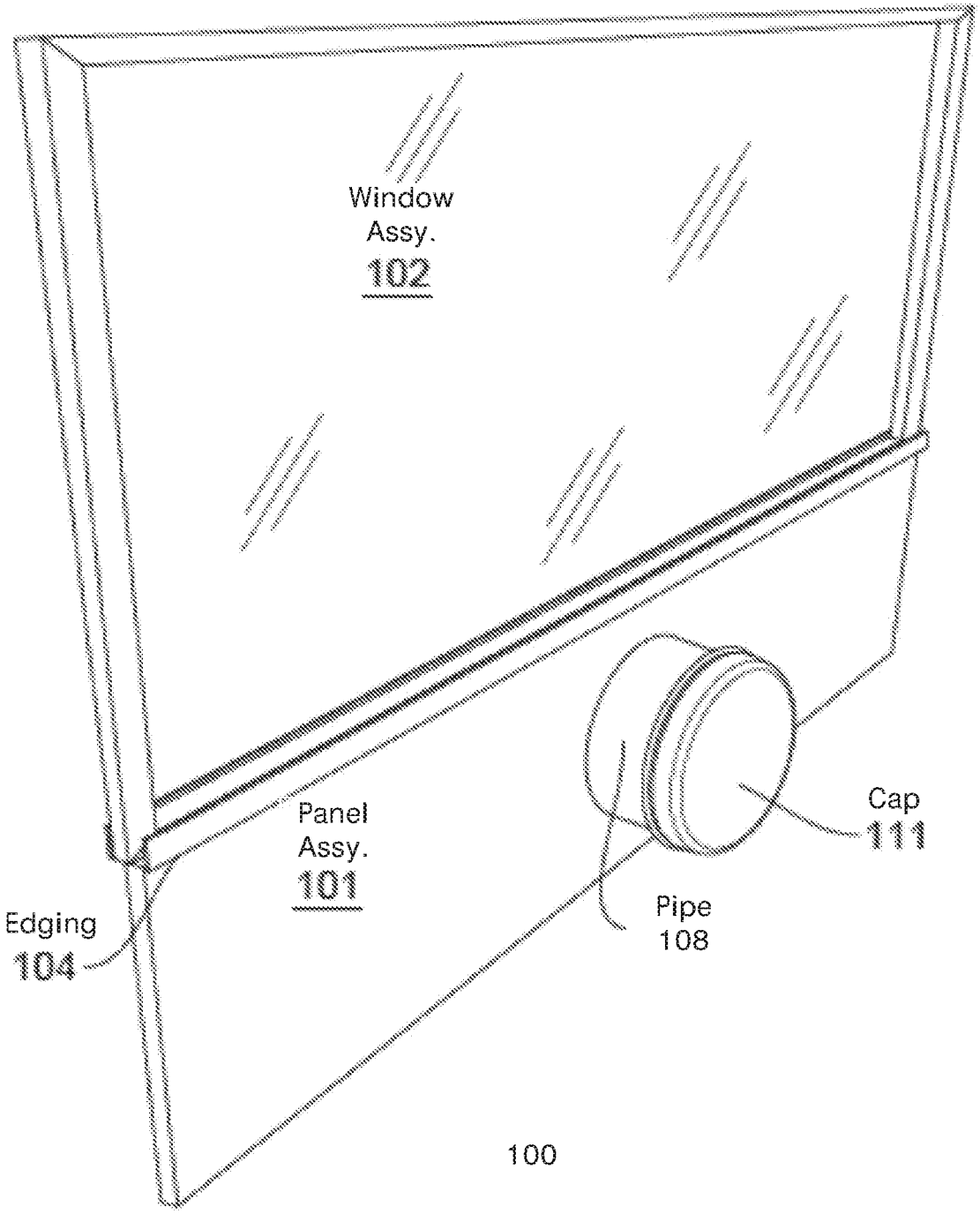
FIG. 11 is a rear (view as seen from inside the building) inclined view of the replacement window panel with AC coupling.

FIG. 11 is a rear (view as seen from inside the building) inclined view of the replacement window panel with AC coupling 100. In this configuration the pipe 108 is typically centrally located in the panel assembly 101. And is shown ready for shipping with the cap 111 in place, and the gasket (not shown) folded up and placed within the capped pipe 108. The window assembly 102 may be coupled to the panel assembly 101 as previously described with edging strips covering the joint formed between the two assemblies.

Figure 12:
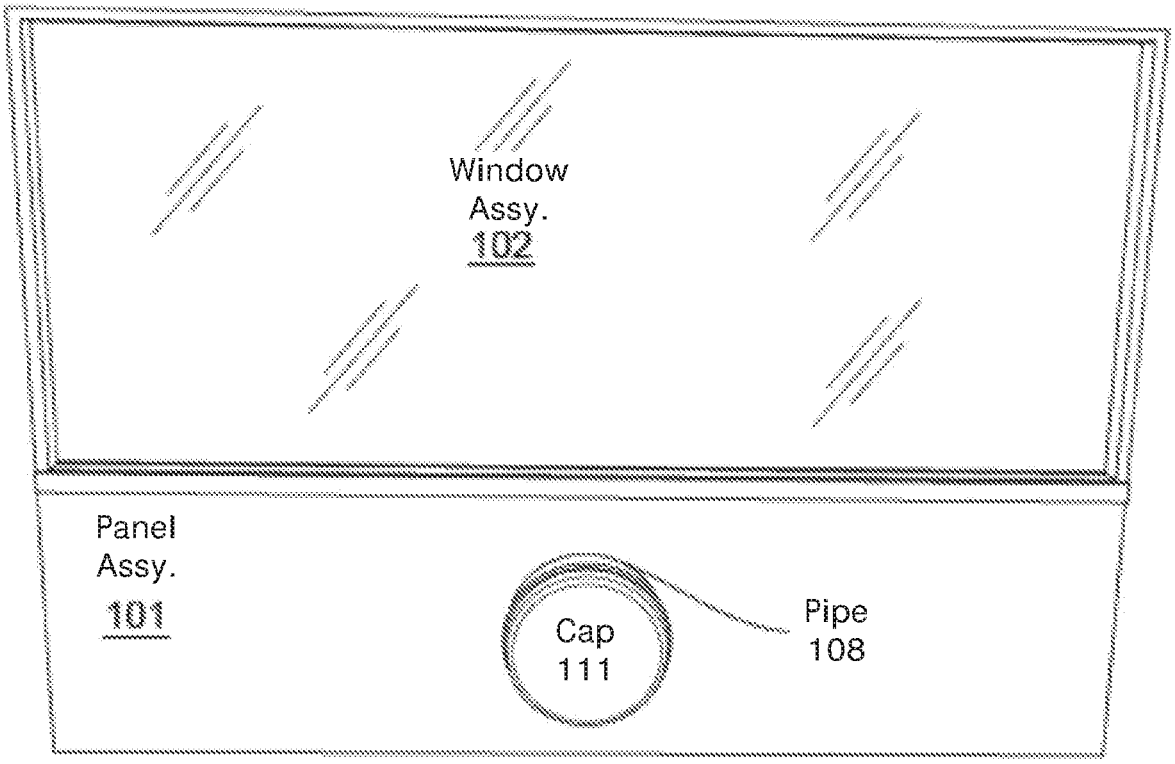
FIG. 12 shows the same components as FIG. 11, however from a rear view with a slightly downward looking perspective.

FIG. 12 shows the same components as FIG. 11, however from a rear view with a slightly downward looking perspective.

Figure 13:
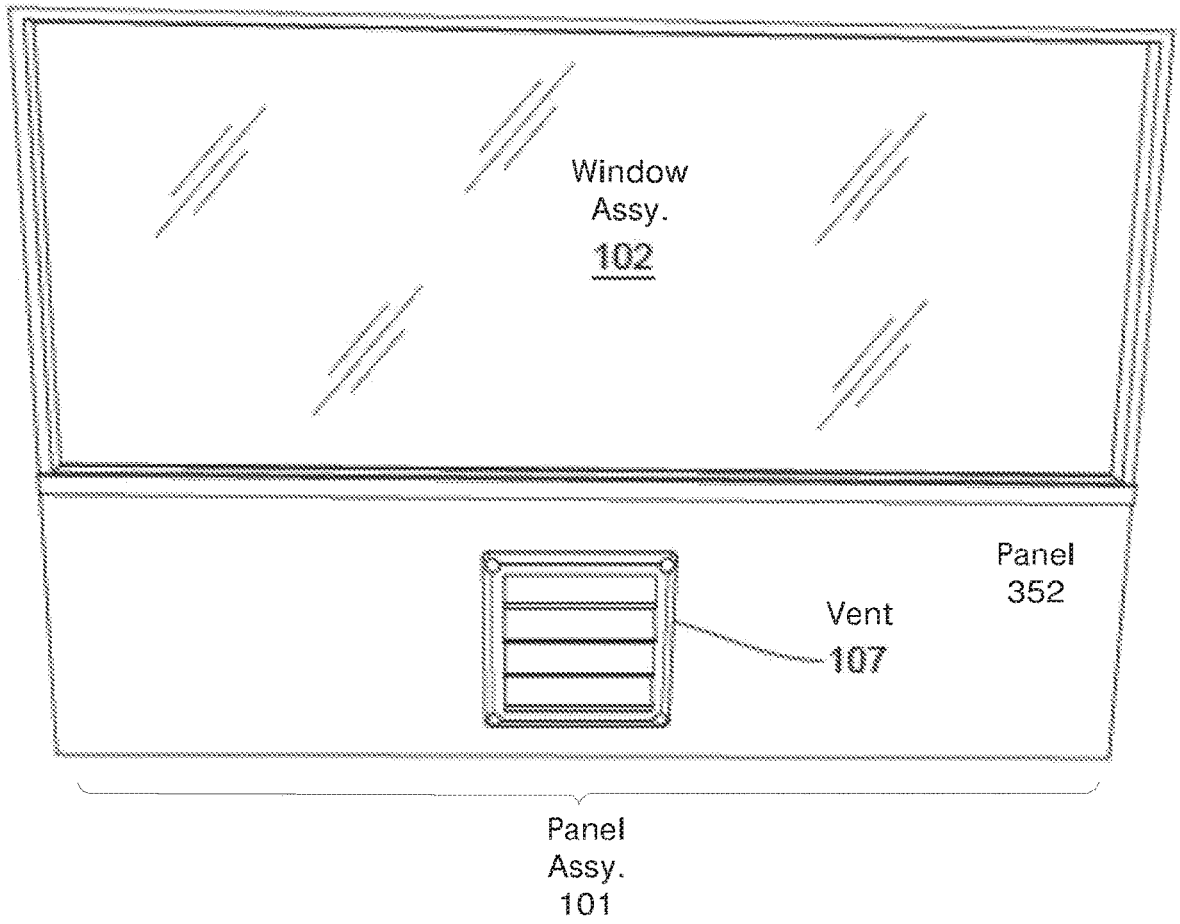
FIG. 13 shows a front (view as seen from outside the building) view of the replacement window panel with AC coupling from slightly downward looking perspective.

FIG. 13 shows a front (view as seen from outside the building) view of the replacement window panel with AC coupling 100 from a slightly downward looking perspective. The window assembly 102 is coupled to the panel assembly 101. On the panel 352 the vent 107 is shown substantially centered, in both the horizontal and vertical dimensions of the panel 352.

Figure 14:
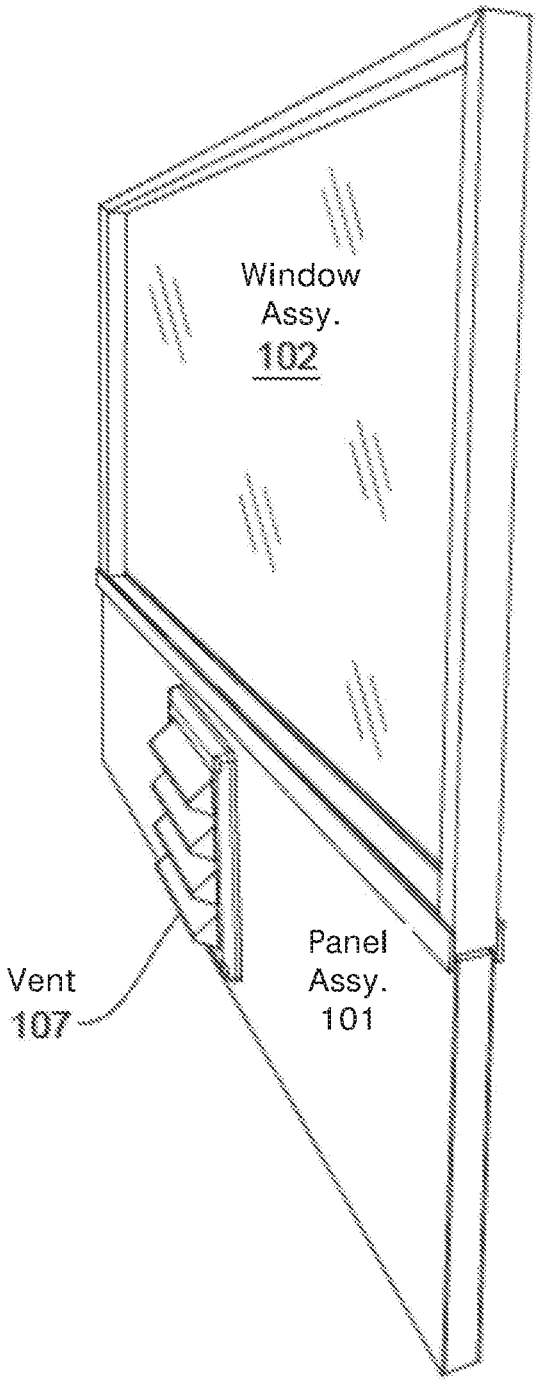
FIG. 14 shows an inclined view from the side of the replacement window panel with AC coupling.

FIG. 14 shows an inclined view from the side of the replacement window panel with AC coupling 100. The construction is as previously described in FIGS. 11-13. However, in this view the vent 107 may be seen to be of the fixed louver type.

Figure 15:
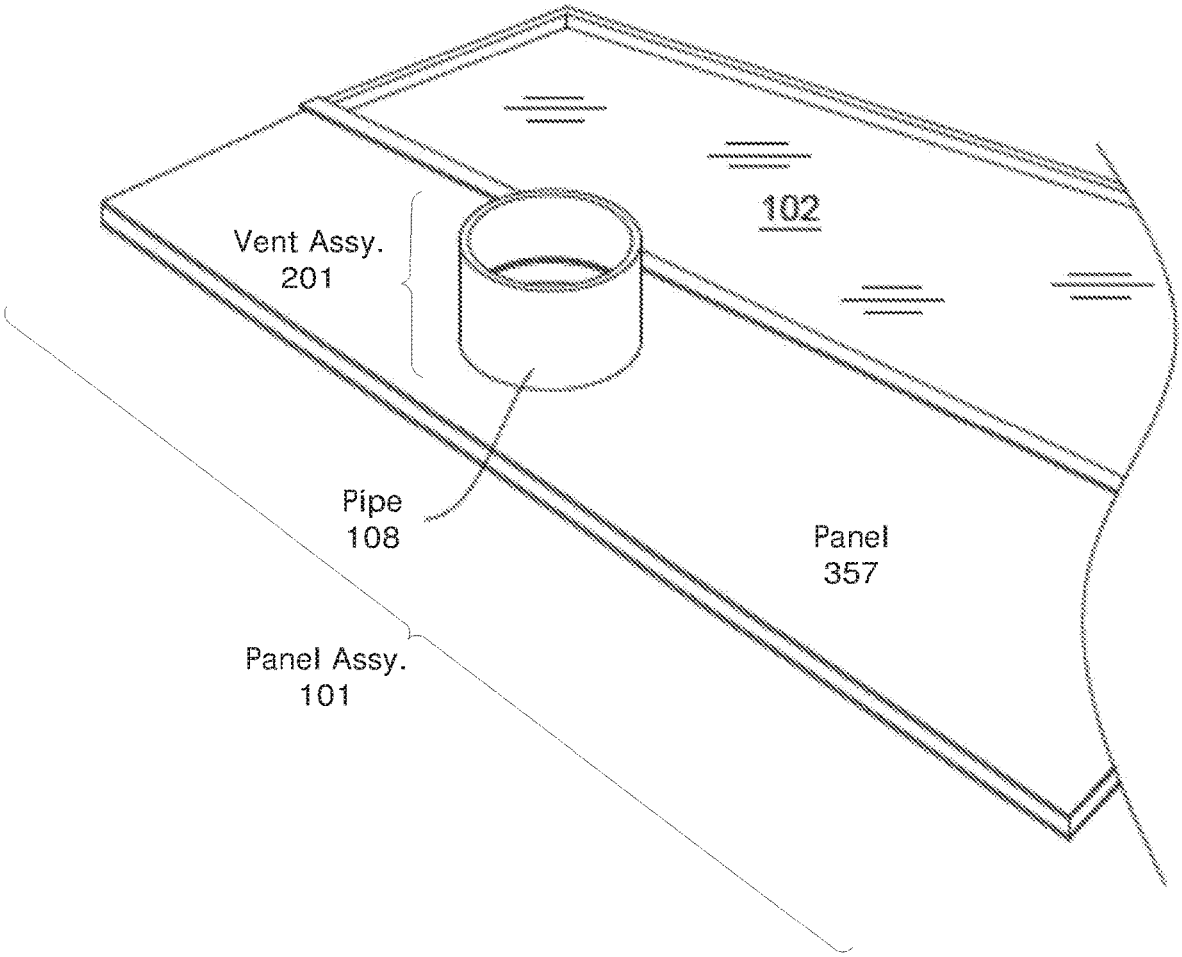
FIG. 15 shows a rear perspective view of the replacement window panel with AC coupling.

FIG. 15 shows a rear perspective view of the replacement window panel with AC coupling 100. The pipe 108 of the vent assembly 201 protrudes through a matching aperture disposed in the panel 357. There is typically little gap between the pipe exterior surface and panel 357, and any gap present may be filled with an appropriate filler.

Figure 16:
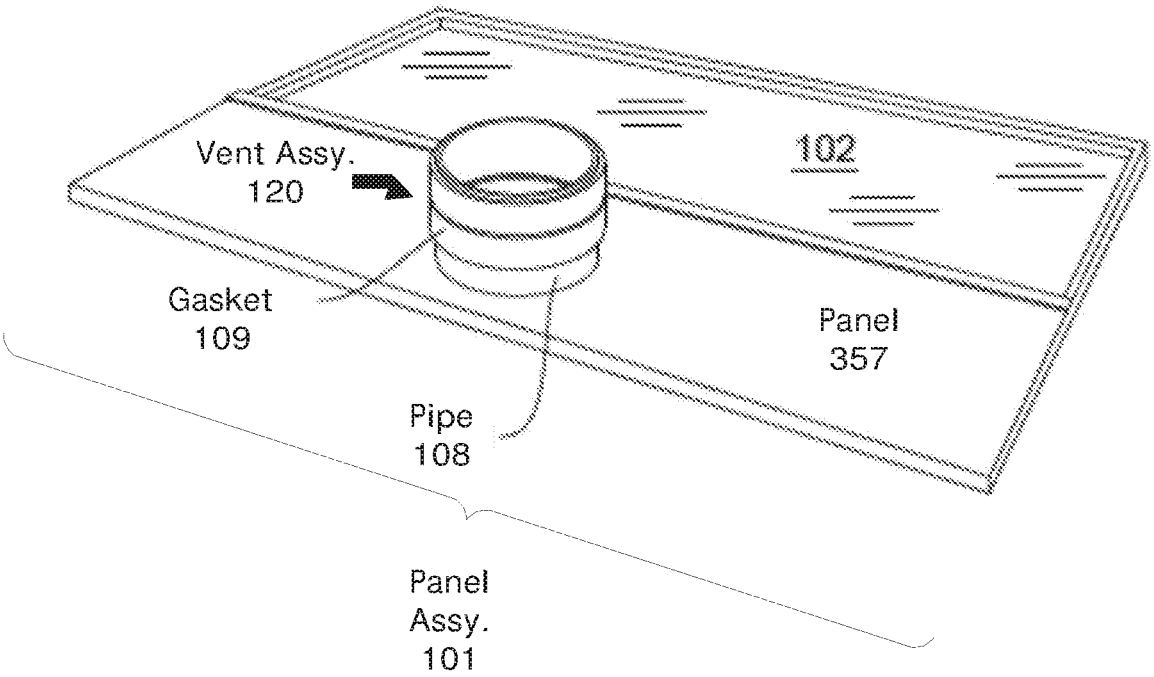
FIG. 16 shows the same features of FIG. 15, but with the placement of the gasket on the pipe.

FIG. 16 shows the same features of FIG. 15, but with the placement of the gasket 109 on the pipe 108.

Figure 17:
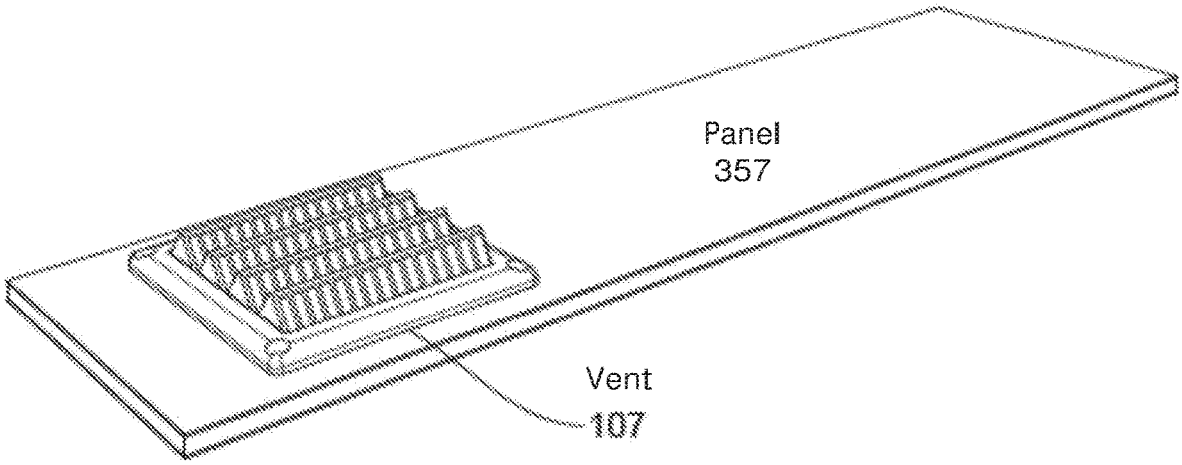
FIG. 17 shows an inclined view of the outside of a panel assembly, looking upwards.
Figure 18:
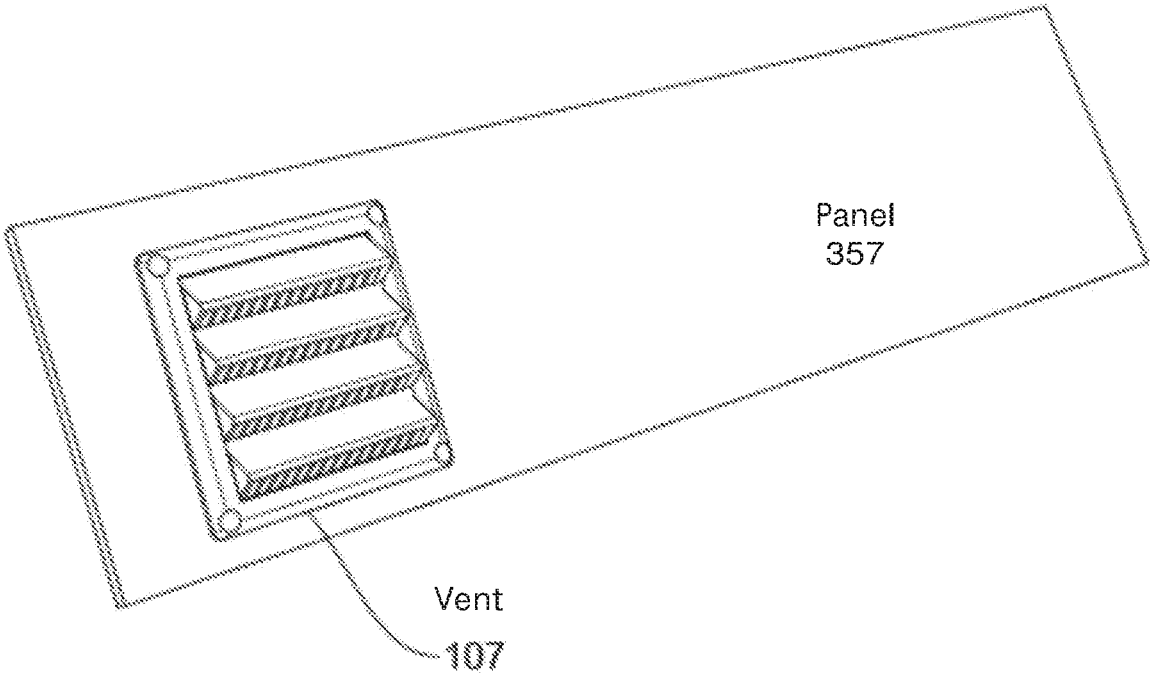
FIG. 18 is an incline view looking downward on the panel assembly.

FIGS. 17-18 show various views of an alternative window replacement panel with an air conditioning coupling having an off center location 200. It will be recognized that the vent 107 may be located in various positions on the panel as desired.

FIG. 17 shows an inclined view of the outside of a panel assembly 101, looking upwards. In this configuration the vent 107 is substantially centered in the vertical dimension on the panel 357. However, in the horizontal dimension the vent 107 is mounts to the side of the panel 357. In an alternative example the vent 107 may be mounted on the opposite side or at any intermediate location there between on the panel 357.

FIG. 18 is an incline view looking downward on the panel assembly 101. This view shows substantially the same features as FIG. 17. However, further details of the fixed vent 107 are visible in this view.

Those skilled in the art will realize that the process sequences described above may be equivalently performed in any order to achieve a desired result. Also, sub-processes may typically be omitted as desired without taking away from the overall functionality of the processes described above.

The invention claimed is:

1. A window replacement panel comprising:
- a window pane of a given width;
- a panel laminate coupled to the window pane, the panel laminate including:
  - a core having a first side and a second side;
  - a first exterior cladding disposed on the first side of the core;
  - a second exterior cladding disposed on the second side of the core; and
  - an aperture disposed in the panel assembly;
- a vent having a flange disposed into the aperture; and
- a pipe having a diameter matching that of the aperture, and attached to the vent for accepting an air conditioner hose;
- whereby the window pane is abutted to and attached to the panel assembly, and the pipe attached to the vent is inserted in the aperture, and the flange is affixed to the panel laminate coupling the vent with the attached pipe to the panel laminate.

2. The window replacement panel of claim 1, in which the window is double pane glass.

3. The window replacement panel of claim 1, in which a width of the window is the same as the panel.

4. The window replacement panel of claim 1, in which the panel is rectangular.

5. The window replacement panel of claim 1, in which the panel is an ACX plywood interior with an exterior aluminum cladding.

6. The window replacement panel of claim 5, in which the exterior aluminum cladding is bonded to the ACX plywood interior.

7. The window replacement panel of claim 1, further comprising
- a first edging strip covering a joint formed in abutting the window to the panel on a first side; and
- a second edging strip covering the joint formed in abutting the window to the panel on a second side.

8. A replacement window panel with air conditioning coupling comprising:
- a window assembly having a given width;
- a panel assembly of a given thickness and of the given width including:
  - a panel laminate including:
    - a core having a first side and a second side;
    - a first exterior cladding disposed on the first side of the core;
    - a second exterior cladding disposed on the second side of the core;

an aperture disposed in the panel assembly;

a vent assembly including:

a louvered vent including a plurality of louvers, and having a front flange with a plurality of apertures disposed therein, accommodating fastening hardware coupling the front flange to the panel assembly, and a rear flange; and a pipe having a diameter matching that of the aperture and a length greater than the thickness, coupled to the rear flange;

whereby the window assembly is abutted to and attached to the panel assembly along the width, and the vent assembly is inserted in the aperture, and affixed to the panel laminate by fastening devices inserted through each of the plurality of panel apertures coupling the vent assembly to the panel laminate.

9. The replacement window panel with air conditioning coupling of claim 8, in which the window assembly is double pane glass.

10. The replacement window panel with air conditioning coupling of claim 8, in which the plurality of louvers are fixed.

11. The replacement window panel with air conditioning coupling of claim 8, in which the plurality of louvers are self closing.

12. The replacement window panel with air conditioning coupling of claim 8, in which the core is ACX plywood.

13. The replacement window panel with air conditioning coupling of claim 8, in which the first and second exterior cladding are aluminum sheeting with an exterior coating.

14. The replacement window panel with air conditioning coupling of claim 8, in which the window assembly abuts the panel assembly and is coupled thereto with ¼'×40 mil thick acrylic foam tape disposed there between.

15. The replacement window panel with air conditioning coupling of claim 8, further comprising at least one edging strip covering a joint formed in the abutting window assembly and panel assembly.

16. The replacement window panel with air conditioning coupling of claim 15, in which the edging is Aluminum covering the joint formed where the window assembly abuts the panel assembly.

17. The replacement window panel with air conditioning coupling of claim 15, in which clear silicone RTV attaches the edging to the joint formed between the window assembly and the panel assembly.

18. The replacement window panel with air conditioning coupling of claim 8, in which a flexible PVC gasket is folded up and placed within a capped pipe.

* * * * *